United States Patent [19]

Capetta

[11] Patent Number: 4,863,054

[45] Date of Patent: Sep. 5, 1989

[54] AMUSEMENT GAME DISPLAY CONTAINER

[76] Inventor: Lou Capetta, c/o Bonita Marie Co., 1555 Rte. 37 W., Ste. 6, Toms River, N.J. 08753

[21] Appl. No.: 234,540

[22] Filed: Aug. 22, 1988

[51] Int. Cl.[4] ..... B65D 43/14

[52] U.S. Cl. ..... 220/4 E; 220/72; 220/339

[58] Field of Search ..... 220/4 B, 4 E, 72, 339

[56] References Cited

U.S. PATENT DOCUMENTS

| | | | |
|---|---|---|---|
| 2,061,610 | 11/1936 | Burnette | 220/4 B |
| 3,346,099 | 10/1967 | Thomas et al. | 220/339 |
| 3,511,433 | 5/1970 | Andrews et al. | 220/4 E |
| 3,662,877 | 5/1972 | McDaniel | 220/4 B |
| 3,786,982 | 1/1974 | Rakes et al. | 220/4 B |

FOREIGN PATENT DOCUMENTS

| | | | |
|---|---|---|---|
| 618912 | 3/1949 | United Kingdom | 220/4 E |
| 2061880 | 10/1980 | United Kingdom | 220/339 |

*Primary Examiner*—A. Michael Chambers

*Attorney, Agent, or Firm*—Clifford G. Frayne

[57] ABSTRACT

A display container for amusement games being made of a clear plastic, cylindrical in shape with hemispherical ends, a circumferential, longitudinal flange and a plurality of horizontal circumferentially, inwardly-depending ribs for frictional engagement to secure the container in the closed position, the container being flexibly hinged along one longitudinal edge of said circumferential flange, the display container encloses an amusement game prize which allows the player of the game to utilize his skill and dexterity in an attempt to obtain the prize.

2 Claims, 3 Drawing Sheets

AMUSEMENT GAME DISPLAY CONTAINER

FIELD OF THE INVENTION

This invention relates to a display container and more particularly, to an economical display container containing prizes in an amusement game which prizes are awarded based on the player's skill and dexterity.

BACKGROUND OF THE INVENTION

Display containers made out of plastic, and in many instances, commonly known as blister packs, are well known in the art. They are used for the display of food, hardware and sundry items. See U.S. Pat. Nos. 4,499,353; 4,576,330; 4,494,650; 4,150,777; 4,127,189; 4,060,173; and 3,837,526. All of the aforementioned patents deal with plastic, blister pack containers with a variety of means for forming said containers and providing for locking devises for said containers. They serve a variety of purposes from displaying food and maintaining the freshest of food until sold to providing for the display and enclosure of small hardware parts such as nuts, bolts and screws.

Applicant's invention is directed towards the amusement game industry and in particular, to amusement games which commonly use a crane mechanism enclosed within a chamber, the chamber being filled with a variety and assortment of prizes. The player would insert the required amount of money to activate the game and then through his dexterity and eye-hand coordination, would attempt to manuever the crane to a position over the prize which he desired. The player would then attempt to manipulate the crane in order to pick up the prize and manuever it to an aperture for award to the player. In the past, such games have contained a variety of economical amusements prizes and are found at fairs, carnivals and boardwalk arcades.

As the popularity for these games increased, the desire for better prizes has become a concern of the owners of the games. Further, the players of such games desire the opportunity to attempt to obtain better prizes. A popular form of prize which has developed is that of costume jewelry which is normally packaged in small plastic containers which are difficult to extract from the game with the crane mechanism and because of their size, such as earrings in a small plastic container, they are not often readily viewable by the player when the chamber is filled. In order to make them more readily viewable, the owner of the game cannot fill the game with sufficient prizes so that the game can operate for a sufficient period of time without restocking. In such a case, if the operator wished to have exclusively jewelry within the game, he could only load the game with approximately one to two levels of prizes and would have to return to the game on a frequent basis for restocking. The operator's desire is to fill the game to its maximum capacity yet still provide the potential player with the opportunity to view the prize and to attempt to extract the prize with the operator returning to restock the game on a more infrequent basis.

Applicant's display container provides for an economical and novel container which can contain securely within it, the plastic container normally associated with costume jewelry. The container permits the operator to stack the game to a sufficient level such that it can be used by potential players for a substantially longer period of time without restocking yet provides the potential player with the opportunity to view and choose the prize which he desires to pursue within the game and provides for a container which is graspable by the crane, thus giving the potential player a better opportunity to obtain the prize.

OBJECTS OF THE INVENTION

An object of the present invention is to provide a novel display container for amusement games which permits the owner operator of the game to fill the game to a greater capacity with quality prizes so that the game can be restocked with prizes on a less frequent basis.

Another object of the present invention is to provide a novel display container for amusement games which permits the operator to offer quality prizes in a container which permits the player to obtain a prize not normally available in the game.

Another object of the present invention is to provide a novel display container for amusement games which permits the player to view the quality of the prize for his selective attempts at obtaining same.

SUMMARY OF THE INVENTION

The instant invention comprises a display container made of clear plastic, being cylindrical in shape with hemispherical ends, said container having a circumferential longitudinal flange and a plurality of horizontal circumferential inwardly depending ribs, said container being secured along one edge of said longitudinal circumferential flange and frictionally securable by means of said opposite circumferential flange and said internal depending ribs for the securing of the prize package within said display container.

BRIEF DESCRIPTION OF THE DRAWINGS

These and other objects of the present invention will become manifest when considered with the accompanying drawings wherein.

DETAILED DESCRIPTION OF THE DRAWINGS

Figure 1:
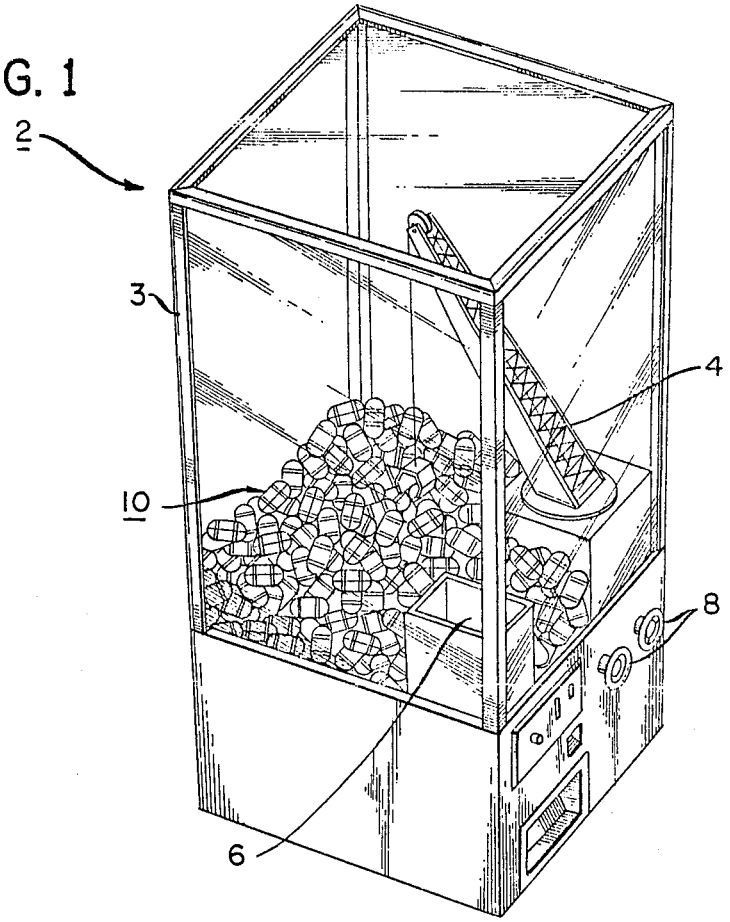
FIG. 1 is a perspective view of the arcade game with display containers.
Figure 2:
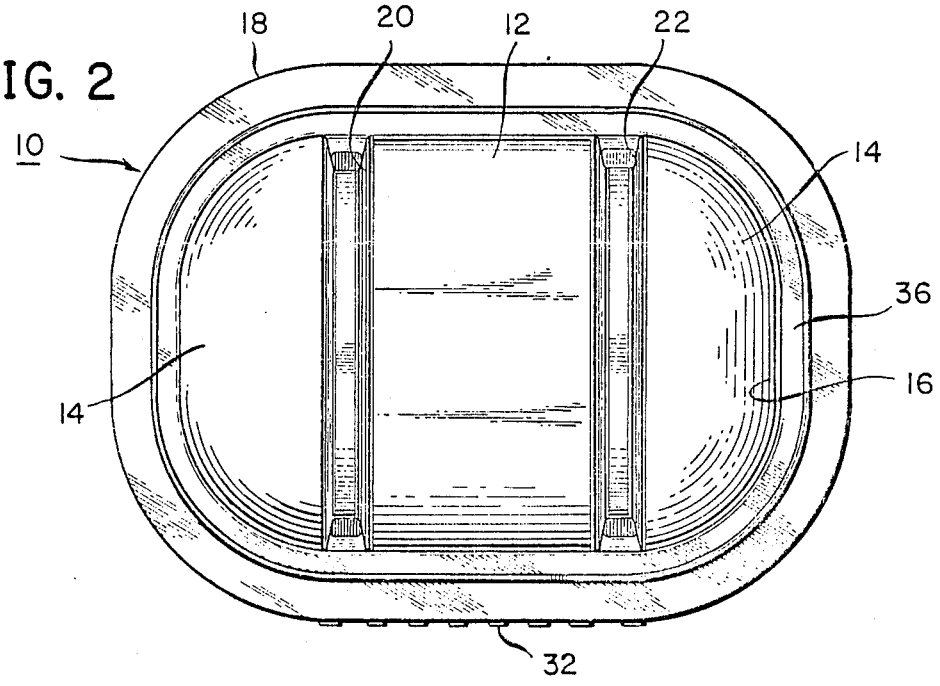
FIG. 2 is a front elevational view of the display container.

Referring to FIG. 1, there is shown a perspective view of an amusement game 2 comprising a housing 3 enclosing a crane mechanism 4 which is utilized to pick up display containers 10 which are stocked within the game and maneuver the display container 10 to an exit chute 6 for award to the player. The player manipulates the crane by a series of control mechanisms 8. The display container 10, as more specifically shown in FIG. 2, a front elevational view, FIG. 3, a side elevational view, and FIG. 4, an end elevational view, is designed to hold a smaller plastic container which encloses the prize. Display container 10 was developed and designed to specifically hold smaller containers which contain jewelry or the like, but the display container 10 can be adapted to enclose any variety of amusement game prizes. It should be noted that the display container as shown in FIG. 2 is its approximate actual size. As can best be seen with reference to FIGS. 3 and 4, display container 10 in the closed position comprises a substantially cylindrical outer wall 12 having substantially hemispherical end walls 14.

Display container 10 is manufactured in two complimentary pieces so as when in a closed position, cylindrical walls 12 and hemispherical end walls 14 define an inner chamber 16 for receipt of the amusement game prize.

As can best be seen in FIG. 2, display container 10 has a circumferential flange 18 extending longitudinally about its equator. Longitudinal flange 18 is in fact, two flanges in contact with each other when display container 10 is in the closed position, each flange being formed on one-half of the display container 10 when manufactured as shown in FIG. 6.

In the embodiment shown in the drawings, display container 10 has two inwardly depending circumferential ribs 20 and 22 formed on cylindrical surface 12. Inwardly depending ribs 20 and 22 serve to provide display container 10 with a degree of structural stability to prevent the inadvertent collapsing of display container 10, and as described hereafter, that also provide for a frictional engaging mechanism for securing the two halves of display container 10 in a closed position. Finally, inwardly depending ribs 20 and 22 serve to aid in permitting the crane mechanism 4 to engage the display container 10 in keeping with the player's efforts to obtain a prize.

Figure 3:
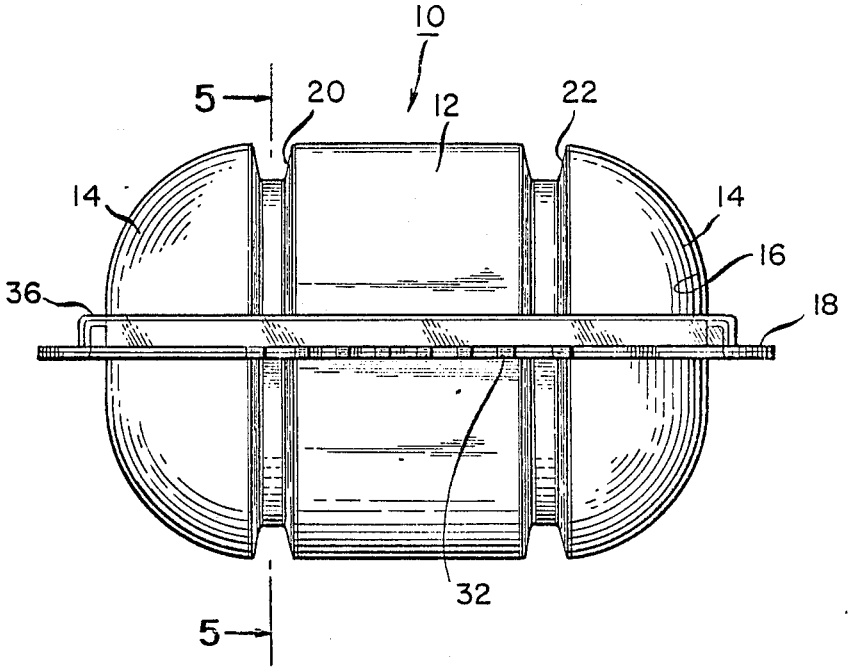
FIG. 3 is a side elevational view of the display container.
Figure 5:
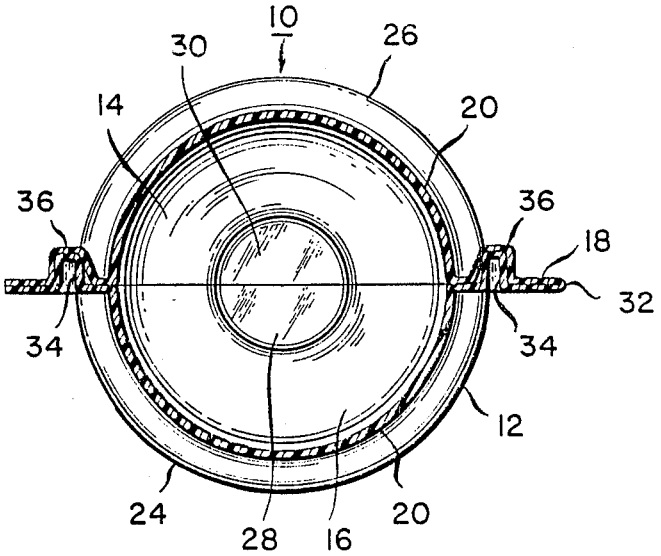
FIG. 5 is a sectional view of the display container in a closed position along plane 5—5.
Figure 6:
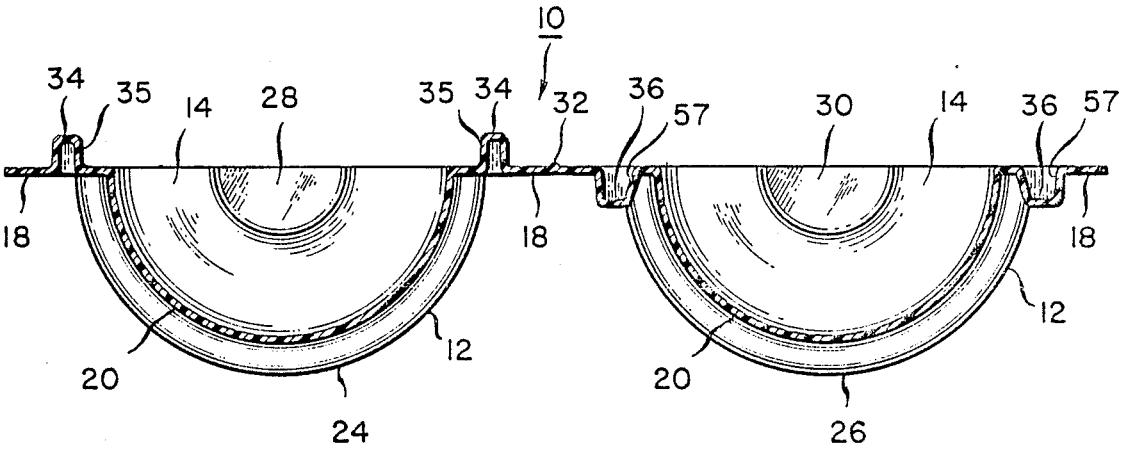
FIG. 6 is a sectional view of the display container in an open position along plane 5—5.

The inner action of inwardly depending ribs 20 and 22 and the frictional engaging mechanism of the two halves of display container 10 is best viewed with reference to FIGS. 5 and 6 which are sectional views in the closed and open modes respectively of display container 10 along plane 5—5 of FIG. 3. With reference to FIG. 6, there is shown display container 10 in its finished manufactured phase. Display container 10 comprises two semi-cylindrical sections 24 and 26, each having a quarter spherical end 28 and 30 respectively which when maneuvered to the closed position by folding over on each other along perforated flange contact 32 results in cylindrical body 12 and hemispherical ends 14.

In manufacture, semi-cylincrical section 24 has an annular protruding lip 34 proximate to circumferential flange 18. The inwardly depending annular lip 36 is formed proximate to flange portion 18 of semi-cylindrical portion 26.

Inwardly depending rib 20 in semi-cylindrical section 24 terminates at a planer level approximately even with annular circumferential flange 18. Inwardly depending rib 20 on semi-cylindrical section 26 terminates at the approximate same level, but is above inwardly depending annular lip 36.

Figure 4:
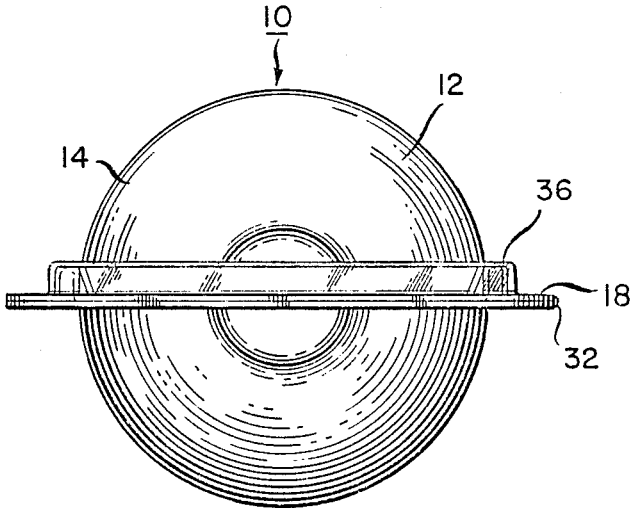
FIG. 4 is an end view of the display container.

As can be seen in FIG. 5, when semi-cylindrical portion 26 is rotated about perforated flange joint 32 upon semi-cylindrical section 24, annular lip 36 engages annular protruding lip 34 so as to frictionally engage display container 10 in a closed position such as that shown in FIGS. 2, 3 and 4. This frictional engagement occurs between outer wall 35 of annular protruding lip 34 and outer wall 57 of annular lip 36 with the upwardly protruding portion of rib 20 in semi-cylindrical section 26 providing outward pressure for frictional engagement.

In this configuration, a prize in its own plastic container may be placed within display container 10 by placing it in chamber 16 and closing the halves of the display container 10 until frictional engagement between annular lips 36 and 34 is accomplished. In this fashion, the prize container is effectively contained within display container 10 for insertion into game 2 in order to test the player's skill and dexterity.

This type of container is inexpensive and easily manufactured and can be reused or discarded and because of its configuration, it can be easily stored within each other in the open container mode.

While the present invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

I claim:

1. An amusement game display container for the display of prizes in an amusement game which tests the operator's skill and dexterity in mechanically obtaining a prize comprizing:

a first portion half and a second portion half formed of transparent semi-resilient material, said first portion half and said second portion half hingeably secured along one longitudinal edge, said first portion and said second portion rotatable about said hinge to frictionally secure said first portion and said second portion together to define a cylindrical body having hemispherical ends and defining a chamber for said prize, said first portion half having an annular circumferential flange and an upwardly depending annular lip from said annular circumferential flange, said second portion having an annular circumferential flange in an annular downwardly depending lip from said annular circumferential flange, said first portion half and said second portion half hingeably secured along one said longitudinal edge, said upwardly depending lip and said downwardly depending lip frictionally engageable to frictionally secure said first portion half and said second portion half in a closed position when said first portion half and said second portion half rotated to said position about said longitudinal hinge.

2. An apparatus in accordance with claim 1 wherein said first portion half and said second portion half have a plurality of circumferential depending ribs perpendicular to the longitudinal axis of said container, said ribs providing resilient stability to the container in the closed position and providing a means to assist the operator in mechanically attempting to obtain the prize contained therein.

* * * * *